US006437767B1

(12) United States Patent
Cairns et al.

(10) Patent No.: US 6,437,767 B1
(45) Date of Patent: Aug. 20, 2002

(54) ACTIVE MATRIX DEVICES

(75) Inventors: Graham Andrew Cairns, Cutteslowe; Michael James Brownlow, Sandford on Thames; Andrew Kay, Oxford, all of (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/054,949

(22) Filed: Apr. 3, 1998

(30) Foreign Application Priority Data

Apr. 4, 1997 (GB) ..... 9706942

(51) Int. Cl.[7] ..... G09G 3/36
(52) U.S. Cl. ..... 345/100; 345/98; 345/696
(58) Field of Search ..... 345/98, 208, 90, 345/204, 694, 696; 348/792; 745/98, 100

(56) References Cited

U.S. PATENT DOCUMENTS

| | | | | |
|---|---|---|---|---|
| 4,447,812 A | | 5/1984 | Soneda et al. | 340/784 |
| 4,830,466 A | | 5/1989 | Matsuhashi et al. | 350/333 |
| 5,041,823 A | * | 8/1991 | Johnson et al. | 345/94 |
| 5,103,218 A | * | 4/1992 | Takeda | 345/100 |
| 5,166,671 A | | 11/1992 | Maekawa | 340/784 |
| 5,192,945 A | * | 3/1993 | Kusada | 345/88 |
| 5,251,051 A | | 10/1993 | Fujiyoshi et al. | 359/85 |
| 5,453,757 A | | 9/1995 | Date et al. | 345/89 |
| 5,745,093 A | * | 4/1998 | Tsuzuki et al. | 345/103 |

FOREIGN PATENT DOCUMENTS

| | | |
|---|---|---|
| EP | 0216188 | 4/1987 |
| EP | 0461928 | 12/1991 |
| GB | 2273194 | 6/1994 |
| JP | 03196780 | 8/1991 |
| JP | 4174822 | 6/1992 |
| KR | 9427543 | 10/1994 |

OTHER PUBLICATIONS

Korean Office Action for Korean Patent Application No. 10–1998–0011982 dated Mar. 21, 2000 and English translations thereof.
Search Report for EP Application No. 98302556.0–2205; Dated Jul. 17, 1998.
Search Report for GB Application No. 9706942.1; Dated Jun. 25, 1997.
Y. Matsueda et al., SID 96 Digest, pp. 21–24, 1996, "Low–Temperature Poly–Si TFT–LCD with Integrated 6–bit Digital Data Drivers".

(List continued on next page.)

*Primary Examiner*—Steven Saras
*Assistant Examiner*—Uchendu O. Anyaso
(74) *Attorney, Agent, or Firm*—Renner, Otto, Boisselle & Sklar

(57) ABSTRACT

An active matrix device includes a data line driver circuit for sampling the input signal to produce data signals for each of the rows of control elements in a corresponding line period, and a scan line driver circuit for addressing the scan lines sequentially by applying a scan signal to the scan inputs of the control elements along each of the rows so as to supply said data signals to the control elements along the row. Such circuits are controlled so that a data input signal is sampled and stored to produce data signals for a first group of the control elements along the row in a first line subperiod and the stored data signals are applied to the first group of control elements in a second line subperiod, and so that the data input signal is sampled and stored to produce data signals for a second group of control elements along the row in the second line subperiod and the stored data signals are applied to the second group of control elements in a subsequent line subperiod.

18 Claims, 13 Drawing Sheets

OTHER PUBLICATIONS

C. Reita, Displays, vol. 14, No. 2, pp. 104–114, 1993, "Integrated Driver Circuits for Active Matrix Liquid Crystal Displays".

R. A. Martin et al., Journal of the SID, 4/2, pp. 65–73, 1996, "The Electronic Document Display: A 6.3–Million–Pixel AMLCD".

S. N. Lee et al., 1990 IEEE International Solid–State Circuits Conference, pp. 220–221, 1990, "A 5×9 Inch Polysilicon Gray–Scale Color Head Down Display Chip".

Pending U.S. application Serial No. 09/055,083, M.J. Brownlow et al., filed on Apr. 3, 1998.

* cited by examiner

ACTIVE MATRIX DEVICES

TECHNICAL FIELD OF THE INVENTION

This invention relates to active matrix devices and is concerned more particularly, but not exclusively, with driver circuits for active matrix liquid crystal displays (AMLCD's).

The invention can be applied, for example, to driver circuits of AMLCD's to be implemented in separate large scale integration (LSI) driver chips, or to be integrated on the display substrate in the form of thin film transistors (TFT) using silicon-on-insulator (SOI) technology. Furthermore the invention can be applied to analogue displays which are supplied with analogue RGB video data, or to digital displays which contain digital-to-analogue (D/A) converters and which have a completely digital interface.

DESCRIPTION OF THE RELATED ART

FIG. 1 shows a typical AMLCD 1 composed of N rows and M columns of pixels addressable by scan lines 2 connected to a scan line driver circuit 3 and data lines 4 connected to a data line driver circuit 5. Data voltages are applied to the data lines 4 by the data line driver circuit 5 and scan voltages are applied to the scan lines 2 by the scan line driver circuit 3 so that such voltages in combination serve to apply analogue data voltages to the pixel electrodes 6 in order to control the optical transmission states of the pixels along each row as the rows are scanned in a cyclically repeating sequence. This is achieved as follows for a single row of pixels. The data line driver circuit 5 reads a line of data to be displayed by the row of pixels and applies corresponding data voltages to the data lines 4 so as to charge up each data line 4 to the required data voltage. The scan line 2 corresponding to the row of pixels to be controlled is activated by the application of the scan voltage by the scan line driver circuit 3 so that a TFT 7 associated with each pixel is switched on to transfer charge from the corresponding data line 4 to a pixel storage capacitance 8 (as shown in broken lines in the figure) associated with the pixel. When the scan voltage is removed the TFT 7 isolates the pixel storage capacitance 8 from the data line 4 so that the optical transmission state of the pixel corresponds to the voltage across the pixel storage capacitance 8 until the pixel is refreshed during the next scanning frame. The rows of pixels are refreshed one at a time until all the rows have been refreshed to complete refreshing of a frame of display data. The process is then repeated for the next frame of data.

In the case of analogue displays, the display data is supplied to the data line driver circuit in the form of an analogue video (AVIDEO) signal which is sampled at a frequency dependent on the resolution and frame rate of the display, the sampling frequency (also referred to as the pixel data rate) being equal to fNM where f is the frame rate of the display.

For analogue displays of small size or low pixel resolution, a point-at-a-time data line driver circuit 10 is commonly employed for the data line driver circuit, as shown in FIG. 2. In this circuit 10 a sampling shift register 11 composed of a chain of D-type flip-flops is connected so that the output of each flip-flop controls the gate of an associated sampling transistor 12 for applying the AVIDEO signal to the corresponding data line 4 with its associated parasitic capacitance shown in broken lines at 13 in the figure. The key feature of such a point-at-a-time driving scheme is that the sampling transistors 12 are directly connected to the data lines 4. In operation frame and line synchronisation pulses VSYNC (not shown) and HSYNC indicate the start of a frame period and a line period respectively, and a clock signal CK at the sampling frequency is applied to the clock inputs of the flip-flops so that a circulating "1" state within the shift register sequentially activates the sampling transistors 12 at the sampling frequency. The RC time constant formed by the resistance of the sampling transistor 12 and the data line 4 (which may have a resistance of several thousand Ohms). and the distributed capacitance of the data line (which may amount in total to tens of picofarads) must be sufficiently less than the available sampling period (1/fNM) for the sampling to be executed successfully.

FIG. 3 is a timing diagram showing the timing of the signals associated with such a point-at-a-time data line driver circuit, where S1, S2 and S3 refer to the scan voltages applied to the first three scan lines numbered from the top of the display. It will be noted that the AVIDEO signal is sampled at the same time as application of the data voltages to the pixels on activation of the scan lines in successive scanning line periods T1, T2 . . . by the scan voltages S1, S2, S3, such scan voltages being synchronised by the HSYNC pulses. However, since the TFT associated with each pixel of the row is turned on while the data for that row is being sampled onto the data lines 4, the pixels towards the right hand side of the display will be charged with the sampled voltage over an effective scan time which is much less than the line period. Indeed, in the worst case, the effective scan time may be little more than the HSYNC pulse period.

For analogue displays of large size or high pixel resolution, the data lines will be both more capacitative and more resistive so that the available sampling period (1/fNM) is too small for the sampling transistor to charge up the data line directly, and the sampling must therefore be buffered. For analogue displays, a small capacitor, which can be charged or discharged very quickly, can be located within each column of the data drive circuit so as to store samples of the AVIDEO signal. The data voltage can then be transferred to each data line by a buffer circuit. However this transfer operation may take several microseconds and this again puts constraints on the time available to scan the right hand side pixels of the display.

FIG. 4 shows at (a) a typical analogue line-at-a-time data line driver circuit 20 such as is more commonly used for buffered sampling, the circuit 20 comprising a sampling shift register 11 comprising a chain of D-type flip-flops as before, but with the outputs of the flip-flops connected to sampling circuits comprising two sets of capacitative memory elements 21 and 22 and line drivers 23 for driving the data lines. FIG. 4 shows at (b) and (c) two alternative circuit arrangements for such a data line driver circuit 20 in which the two sets of memory elements comprise two capacitors 25, 26 or 27, 28 and associated switches 25A, 26A, or 27A, 27B, 28A, 28B for each data line and the line drivers comprise a buffer 29 or 30 for each data line, as will be described in more detail below.

FIG. 5 shows a timing circuit for such a line-at-a-time data line driver circuit for comparison with the timing circuit of the point-at-a-time data line driver circuit of FIG. 3. The important feature of the line-at-a-time driving scheme is that the scan line is activated only after a complete line of data has been sampled during a line period T1, the next complete line period T2 being used for scanning of the data to the pixels as well as sampling of the data for the next row of pixels. Because sampling and data line driving cannot occur simultaneously, each sampling circuit includes two sets of memory elements 21 and 22 as shown in FIG. 4(*a*). In the first circuit arrangement of FIG. 4(*b*), each capacitor 25 is used for sampling a corresponding point in a line of data and its charge is then shared with the capacitor 26. The capacitor 26 and buffer 29 are then used to drive the data line, leaving the capacitor 25 free to sample a corresponding point in the next line of data. In the second circuit arrangement of FIG. 4(*c*), on the other hand, the capacitor 27 is used for sampling a corresponding point in a line of data while the capacitor 28 and buffer 30 are driving the data line. During the next line period,. the capacitor 27 and the buffer 30 are used to drive the data line while the capacitor 28 is being used for the next line sample. In both these cases two whole lines of video data are stored in analogue memory at any one instant. However this single-line pipeline incurs a significant overhead both in terms of number of components and control circuit complexity.

In the case of digital displays, the data line driver circuits normally use a line-at-a-time driving scheme so that it is necessary to use line memories, usually based on latches. A typical digital data line driver circuit comprises an input register to which digital video data is supplied, for example in 6 or 8 bit RGB format, a storage register in the form of digital latches, and digital-to-analogue (D/A) converters connected to the outputs. of the storage register and supplied with reference voltages for applying data to up to 24 parallel digital data lines by way of output buffers. As the digital data bits are supplied to the input register, they are stored in the register and, when a whole line of data has been stored, the contents of the input register are transferred to the storage register in order to control the D/A converters. In the case of small screen displays, the D/A converters may be connected directly to the data lines so as to charge the data lines by simple charge sharing, although output buffers are required for higher performance displays. The D/A converters most commonly used are parallel converters (such as are referred to by Y. Matsueda, S. Inoue, S. Takenaka, T. Ozawa, S. Fujikawa, T. Nakazawa and H. Ohshima, "Low-temperature poly-Si TFT-LCD with integrated 6-bit digital data drivers", Society for Information Display 96 Digest, pages 21–24) and ramp converters. However the digital line memory required for such a circuit is difficult to achieve with SOI digital driver integration.

It is known to use two scan line driver circuits to charge up the same scan line, as disclosed in C. Reita, "Integrated driver circuits for active matrix liquid crystal displays", Displays 1993, Vol. 14(2), pages 104–114, and R. Martin, T. Chuang, H. Steemers, R. Fulks, S. Stuber, D. Lee, M. Young, J. Ho, M. Nguyen, W. Meuli, T. Fiske, R. Bruce, V. Da Costa, R. Kowalski, A. Lewis, W. Turner, M. Thompson, M. Tilton and L. Silverstein, "The electronic document display: A 6.3-million-pixel AMLCD", Journal of the Society for Information Display 1996, Vol. 4(2), pages 65–73, for example. There are two advantages to such a driving scheme which are particularly relevant to circuits which are integrated on the same substrate as the display. The first advantage is that the circuit is rendered more tolerant to faults. The second advantage is that two scan line buffers can be used to charge up the significant capacitance of the scan line and connected TFT's more quickly and evenly. Furthermore it is known for the scan lines to be physically split down the centre of the display so that the display consists of two display parts which are scanned by separate scan line driver circuits connected to opposite edges of the display. Such an arrangement can be effected on a substrate which is common to the two display parts, or alternatively the display parts may be constituted by two display substrates which are bonded together edge to edge to make a larger area display. In both cases the scan lines of both display parts are controlled so that the same line is activated in the two parts at the same time.

SUMMARY OF THE INVENTION

U.S. Pat. No. 4,830,466 discloses an AMLCD 32 in which the scan lines are split down the centre of the display into left and right hand scan line parts 33 and 34 as shown in FIG. 6. The scan line parts 33, 34 are activated in one line period of a point-at-a-time driving scheme, in which the left hand scan line part 33 is activated during the first half of the line period and the right hand scan line part 34 is activated during the second half of the line period. This allows more time for charging of the pixels by the data line driver circuit 37 towards the right hand side of the display as compared with a conventional point-at-a-time driving scheme as described above with reference to FIG. 3. It is to be noted that the two scan line parts 33 and 34 are scanned in a single scanning operation in which a line of data is read and applied to the data lines during application of the scan voltage, but in which the left and right hand scan lines are independently controlled.

It is an object of the invention to provide a novel active matrix device which is applicable to both analogue and digital displays and which ensures driving of the display in an efficient manner without undue circuit complexity.

According to the present invention there is provided an active matrix device comprising a plurality of data lines, a plurality of scan lines, an active matrix of control elements arranged in rows and disposed at intersections of the data lines and scan lines and having data inputs connected to the data lines and scan inputs connected to the scan lines such that each control element is addressable by a combination of data and scan signals applied to a corresponding one of the data lines and a corresponding one of the scan lines, and addressing means for addressing the rows of control elements in successive line periods in response to an input signal, the addressing means comprising data line driver circuit means for sampling the input signal to produce data signals for each of the rows of control elements in a corresponding line period and for applying said data signals to the data lines, and scan line driver circuit means for addressing the scan lines sequentially by applying a scan signal to the scan inputs of the control elements along each of the rows so as to supply said data signals applied to the data lines to the control elements along said row on receipt of said scan signal by the control elements, wherein the addressing means comprises first actuating means for sampling and storing the input signal to produce data signals for a first group of the control elements along said row in a first subperiod of said one line period and for supplying said data signals to the first group of control elements in a second subperiod of said one line period, and second actuating means for sampling and storing the input signal to produce data signals for a second group of control elements along said row in a subperiod which is at least partly coextensive with the second subperiod and for supplying said data signals to the second group of control elements in a subsequent subperiod.

Such an arrangement provides a number of significant advantages as compared with an arrangement utilising a conventional line-at-a-time driving scheme as described above with reference to FIGS. 4 and 5. These advantages render the arrangement particularly applicable to monolithic driver circuits for liquid crystal display devices in which the driver circuits are implemented on the same substrate as the display. The most significant advantage of such an arrangement is that it enables the data line driver circuit means to be implemented utilising only a single data memory for each data line. This is because, instead of the requirement of simultaneous storage for sampling and for driving of the conventional line-at-a-time driving scheme, the same data memory may be used for both sampling and driving in such a part-line-at-a-time driving scheme. It will be appreciated that this provides a significant reduction in the number of components and the circuit complexity of the data line driver circuit means. Furthermore such an arrangement is particularly advantageous when it is applied to digital data drive architectures since the area and power consumption overheads are dramatically reduced. A smaller number of components also increases the yield obtained in fabrication of the device. When applied to analogue data drive architectures, the arrangement is able to offer greater precision in operation than conventional analogue line-at-a-time driving schemes where accuracy is lost by transferring charge from one capacitative memory element to another capacitative memory element, or because of minor mismatches of the capacitative memory elements within a column driver.

In one embodiment of the invention the data line driver circuit means comprises first and second driving means, the first actuating means comprises first switching means for isolating the first driving means from the first group of control elements in the first subperiod and for coupling the first driving means to the first group of control elements in the second subperiod, and the second actuating means comprises second switching means for isolating the second driving means from the second group of control elements in the second subperiod and for coupling the second driving means to the second group of control elements in said subsequent subperiod. This may be referred to as a switchable data line bank driving scheme.

In an alternative embodiment the scan lines comprise first and second separately addressable scan line parts, the first actuating means comprises first scanning means of the scan line driver circuit means for applying a first scan signal to the first scan line part to supply said data signals to the first group of control elements in the second subperiod, and the second actuating means comprises second scanning means of the scan line driver circuit means for applying a second scan signal to the second scan line part to apply said data signals to the second group of control elements in said subsequent subperiod. This may be referred to as a split scan line driving scheme.

Such a split scan line driving scheme presents a number of advantages as compared with conventional line-at-a-time driving schemes as described above with reference to FIGS. 4 and 5. Firstly, because the scan lines are shorter, they are less likely to snap or kink. Also the capacitative loading which the scan lines present to the scan line buffers is substantially decreased, and accordingly the scan line buffers can be made smaller. Alternatively, if the buffer drive capability is maintained, the RC time constant of the line can be increased with no loss in system performrmance. The scan lines can therefore be made narrower, thus improving pixel aperture ratio in the case of a display device.

BRIEF DESCRIPTION OF THE DRAWINGS

In a further development of the invention the data lines corresponding to the first scan line are connected to first and second line drivers of the data line driver circuit means by first and second switching means, the data lines corresponding to the second scan line are connected to third and fourth line drivers of the data line driver circuit means by third and fourth switching means, and the data line driver circuit means is adapted to apply data signals to data lines of subgroups of the first and second groups of control elements while the input signal is being sampled for other subgroups of the first and second groups of control elements during each subperiod.

In order that the invention may be more fully understood, reference will now be made, by way of example, to the accompanying drawings, in which.

DETAILED DESCRIPTION OF THE INVENTION

Preferred embodiments of the invention applied to an AMLCD will now be described with reference to FIGS. 7 to 18 of the drawings, although it should be understood that the invention is also applicable to other types of active matrix device. In each of the described embodiments the analogue or digital data line driver circuits operate with only a single line memory by utilising a part-line-at-a-time driving scheme in which the pixels along a row are addressed in two or more groups during the line period so that, during a first subperiod of the line period, the input data is sampled by the data line driver circuit to produce data signals for a first group of pixels along the row and, during a second subperiod of the line period, the data signals are applied to the first group of pixels whilst the data line driver circuit samples the input data to produce data signals for a second group of pixels along the row. Such part-line-at-a-time driving is achieved by a data line driver circuit composed of two or more banks which successively perform data sampling and data line driving at the line scanning frequency but out of phase with one another, for example by half a line period where the matrix is driven a half line at a time. It will be appreciated that, when a first bank of the data line driver circuit has completed sampling, its mode of operation changes to that of driving, and a second bank of the data line driver circuit effects sampling at the same time as the first bank effects driving.

Two alternative embodiments of the invention will now be described in which the data line driver circuit is divided into two halves by the division of the column data drivers into left and right hand halves relative to the centre of the display so as to address the active matrix a half line at a time using a single line memory. However it will be appreciated that the data line driver circuit can be divided in different proportions or into more than two parts, and furthermore the division of the column data drivers need not be symmetrical relative to the centre of the display (for example the display data may be transmitted in scrambled format).

Figure 7:
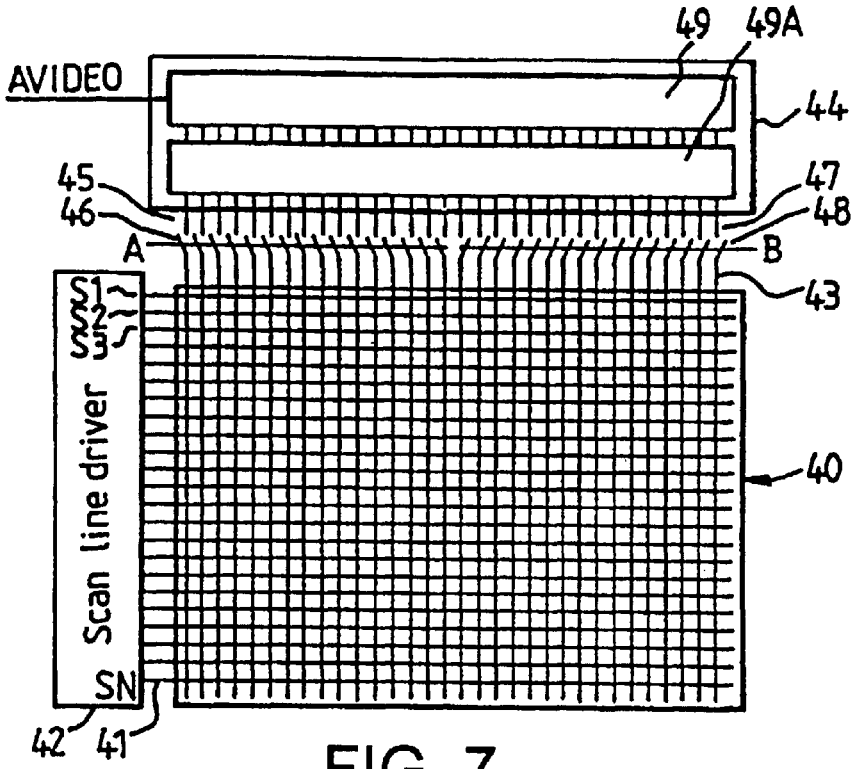
FIGS. 7 and 8 show an AMLCD according to a first embodiment of the invention and corresponding timing diagram.

FIG. 7 shows an AMLCD 40 according to a first embodiment of the invention composed of N rows and M columns of pixels addressable by scan voltages S1 . . . SN applied to scan lines 41 by a scan line driver circuit 42 and data voltages applied to data lines 43 by a data line driver circuit 44 (as will be described in more detail below with reference to FIGS. 11 and 12). The outputs of the data line driver circuit 44 are divided into two banks, that is a left hand bank 45 connected to a left hand group of pixels by switches 46 controlled by a signal A and a right hand bank 47 connected to a right hand group of pixels by switches 48 controlled by a signal B. Considering first the left hand bank 45, the switches 46 are open when the signal A is low so that the left hand line drivers are disconnected from the data lines in order to sample the input data for the left hand group of pixels. When the signal A is high, the switches 46 are closed so as to connect the left hand line drivers to the data lines to effect charging of the left hand group of data lines. A similar sequence of operations is effected with the right hand bank 47 utilising the signal B to effect sampling and driving for the right hand group of pixels, the A and B signals being carefully coordinated with the scan line signals to ensure that the switches 46 and 48 are half a line period (1/2 fN) out of phase with one another.

Figure 8:
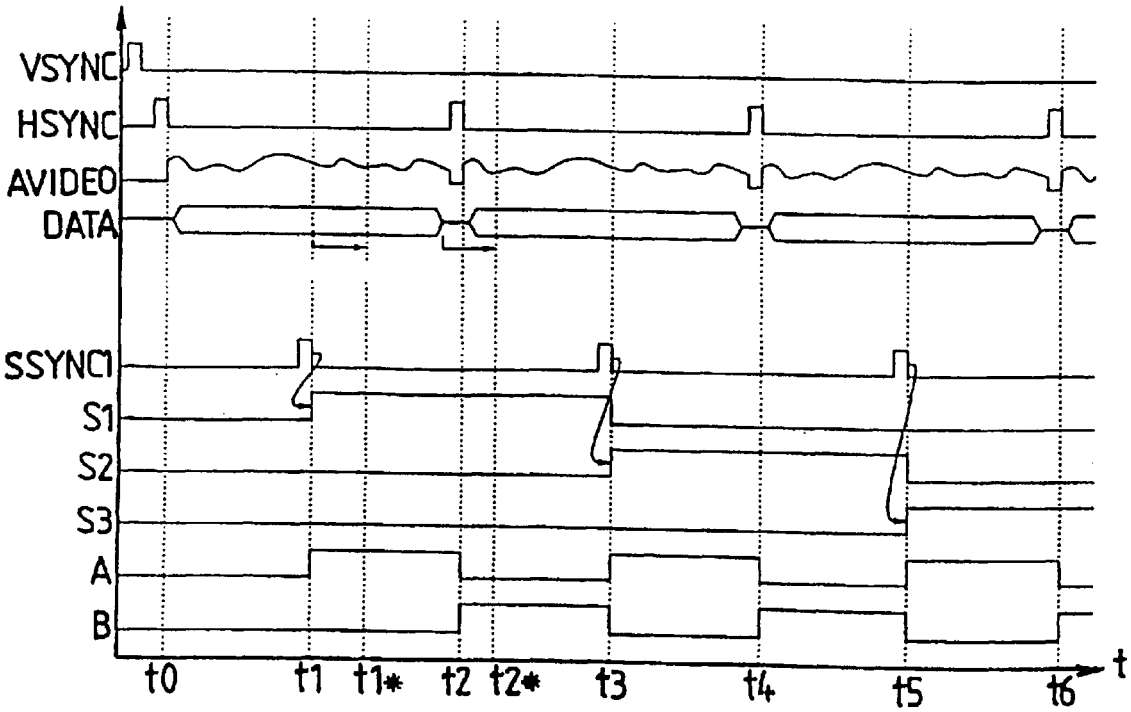

The complete driving scheme utilised in the embodiment of FIG. 7 is best understood by reference to the timing diagram of FIG. 8 which shows the switch signals A and B, together with the first three scan line voltages S1, S2 and S3, the frame and line synchronisation pulses VSYNC and HSYNC, a typical analogue input signal AVIDEO for an analogue driver circuit and a typical digital input signal DATA (which in practice might be a parallel RGB bus up to 24 bits wide) for a digital driver circuit. In this regard the data line driver circuit 44 incorporates either a digital or analogue single line memory 49 and associated line drivers 49A in the form of D/A converters and/or buffers, depending on whether the data line driver circuit is an analogue driver circuit or a digital driver circuit.

Considering first the case of an analogue data line driver circuit, the first line of data is transmitted by the AVIDEO signal following receipt of the VSYNC and HSYNC pulses, and the first half of the line data is sampled between time t0 and t1. At t1, the scan voltage S1 and signal A are activated and, between t1 and t2, the scan voltage S1 is applied and the switches 46 are closed so that the line drivers of the left hand bank charge the left hand group of pixels along the scan line. During the same period, the data for the right hand group of pixels is sampled by the right hand bank. At t2, the signal A is de-activated (after all the left hand pixels have been charged to their appropriate voltages) and the signal B is activated to close the switches 48. Between t2 and t3, the right hand line drivers charge the right hand group of pixels, and, during the same period, the data for the left hand group of pixels for the next scan line is sampled by the left hand bank. It is to be noted that the left hand group of pixels is still being scanned during this period but that the data lines from which they are charged have been isolated. Operation proceeds in a similar manner for the remaining scan lines in the display.

For a digital data line driver circuit, operation is complicated by the fact that D/A conversion takes place in the driver circuit, as described below with reference to FIG. 12, and this introduces a tighter constraint on D/A conversion. The DATA signal is transmitted at a fixed interval (the horizontal front porch) after the falling edge of the HSYNC pulse at time t0. The arriving parallel data bits are sampled as they arrive and the D/A converters commence operation, the conversion delay t1 to t1* being dependent on the speed and type of D/A converter. At t1, the scan voltage S1 and signal A are activated, and the D/A conversion and data line charging must be completed within the half line period t1 to t2. In the example shown, all the D/A conversions are completed for the left hand group of pixels by time t1*. FIG. 8 also shows that the scan signals are controlled by the falling edge of a signal SSYNC 1, and the generation of this signal will be explained below. The pattern of the scan line signals is the same as for a conventional line-at-a-time driving scheme except that the signals are activated half a line period earlier. This means that standard scan line driver circuits can be used in this embodiment.

Figure 9:
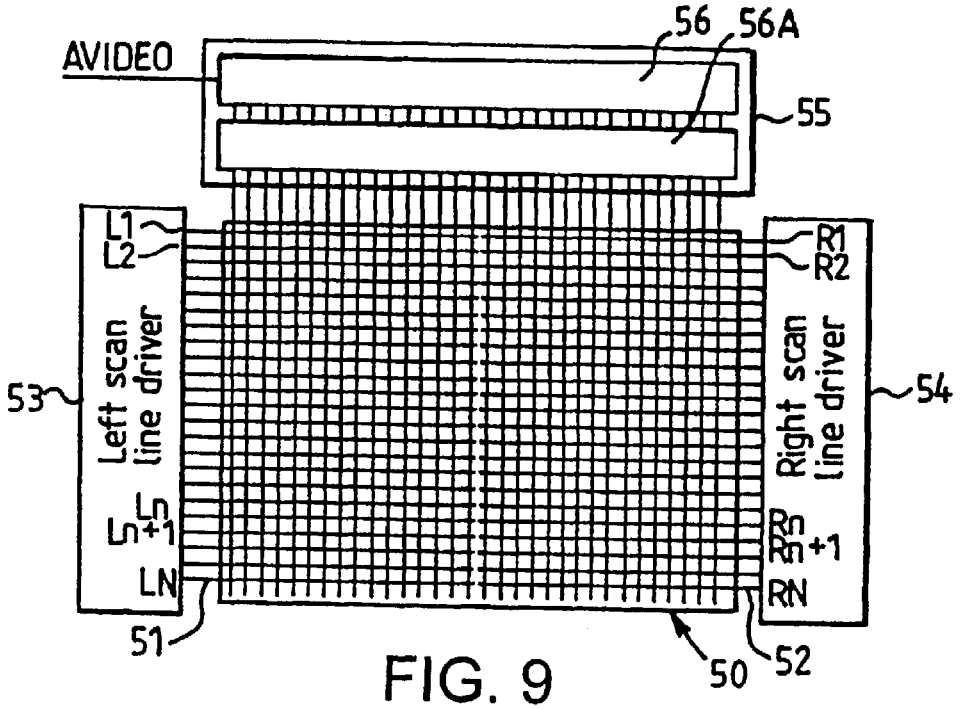
FIGS. 9 and 10 show an AMLCD according to a second embodiment of the invention and corresponding timing diagram.

FIG. 9 shows a second embodiment of the invention utilising a half-line-at-a-time driving scheme based on split scan lines. In this case each row of pixels within the AMLCD 50 of N rows and M columns has two scan lines 51 and 52, the scan line 51 connecting the gates of the TFT's of the left hand group of pixels to a left hand scan line driver circuit 53 and the scan line 52 connecting the gates of the TFT's of the right hand group of pixels to a right hand scan line driver circuit 54. The scan lines 51 and 52 do not overlap so that the pixel aperture ratio is only compromised in the horizontal direction by the width of a single scan line. The two scan line driver circuits 53 and 54 are located at opposite sides of the display and generate signals out of phase with one another by half a line period, the timing of the signals being fundamental to correct operation of the driving scheme. As in the previous embodiment the data line driver circuit 55 comprises a single digital or analogue line memory 56 and line drivers 56A in the form of D/A converters and/or buffers, as will be described in more detail below with reference to FIGS. 11 and 12.

The operation of the embodiment of FIG. 9 will now be described with reference to the timing diagram of FIG. 10 in which the voltages L1, L2 applied to the first two left hand scan lines 51 and the voltages R1, R2, RN applied to the first two and last right hand scan lines 52 are shown. Ignoring the scan voltage RN for the time being, the data for the pixels scanned by the scan voltage L1 is sampled between t0 and t1. At t1, the scan voltage L1 is activated. Between t1 and t2, the left hand line drivers of the data line driver circuit 55 charge the left hand group of pixels while the data for the pixels scanned by the scan voltage R1 is sampled by the right hand side of the data line driver circuit 55. At t2 the scan voltage L1 is de-activated and the scan voltage R1 is activated so that the right hand line drivers of the data line driver circuit 55 charge the right hand group of pixels and the left hand side of the data line driver circuit 55 starts to sample the data for the next scan line. This cycle of interleaved left and right scanning is repeated for each row of the display. Because of the half line period pipeline delay, the right hand group of pixels along the last scan line are not scanned by the scan voltage RN until the beginning of the next scanning frame.

Figure 10:
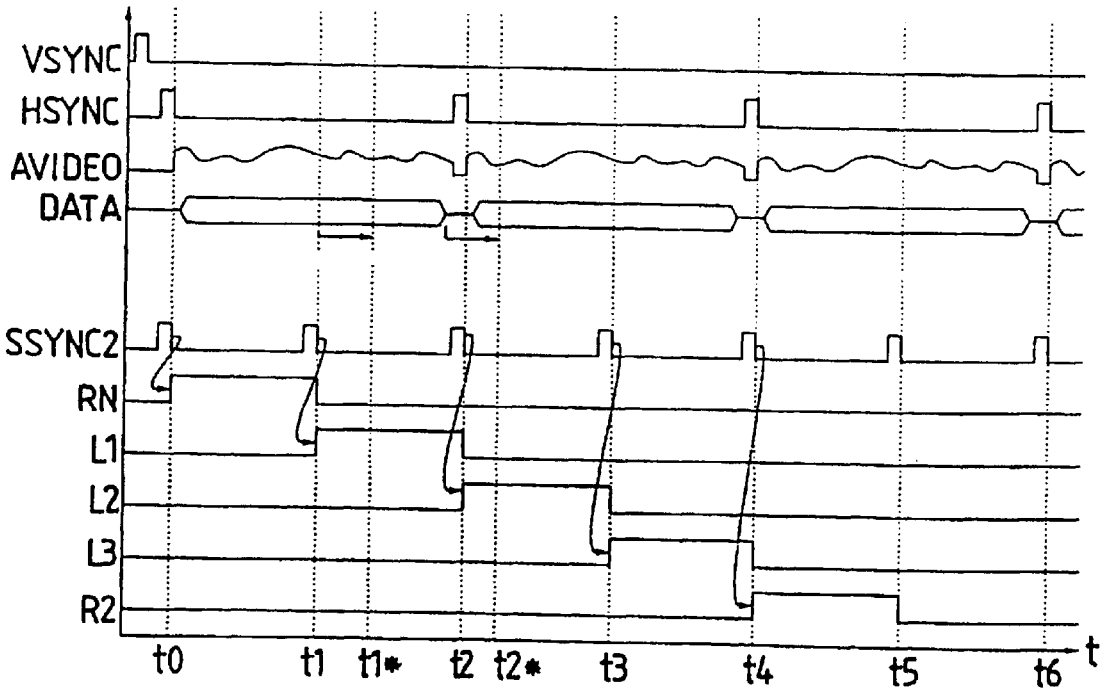

For a digital data line driver circuit, driving is effected in a similar manner except that, for the driving scheme to execute successfully, the D/A conversion and data line charging must be completed within a half line period, so that t1* must precede t2 and t2* must precede t3 in FIG. 10. The non-standard scan line driver circuits for such a split scan line driving scheme and the generation of the SSYNC2 pulse for controlling the scan line driver circuits will be explained below with reference to FIGS. 14 and 15.

Figure 1:
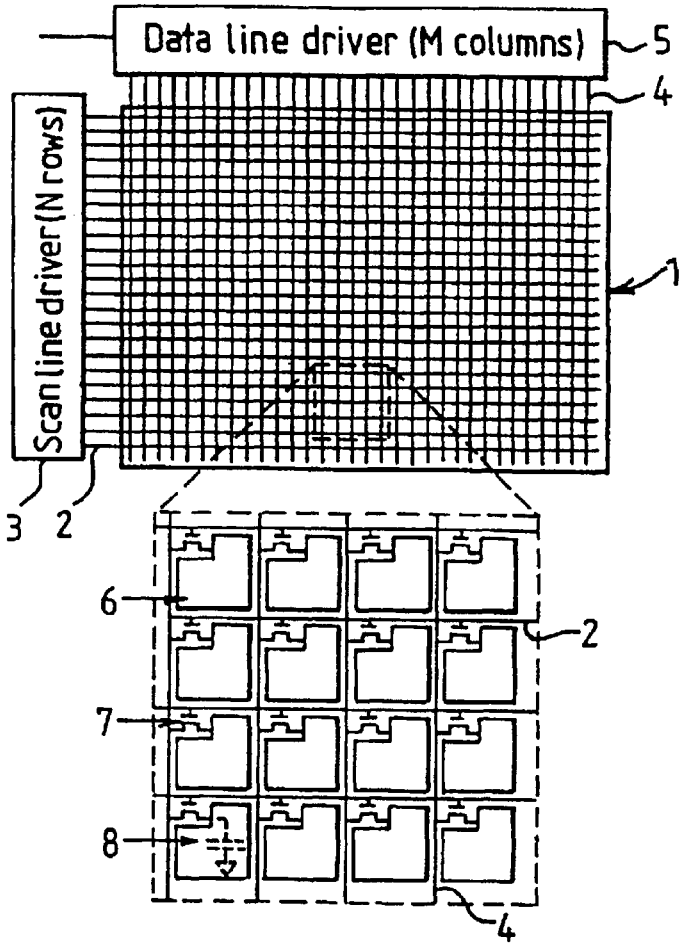
FIG. 1 diagrammatically shows a prior art AMLCD.
Figure 2:
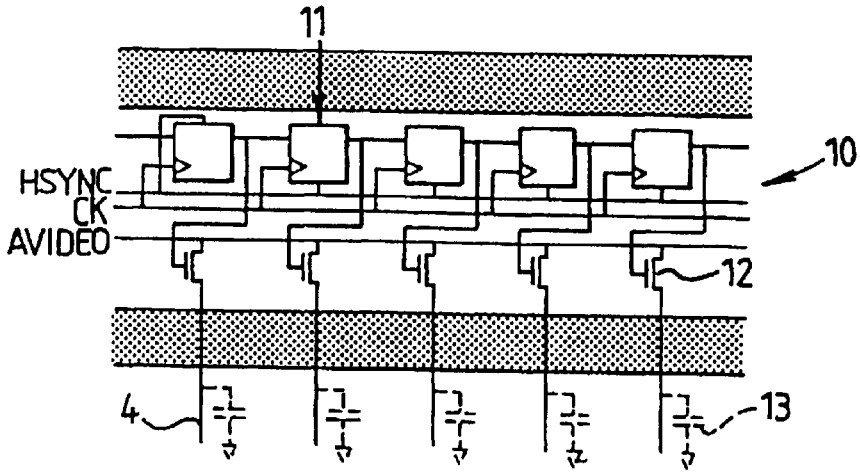
FIGS. 2 and 3 show a prior art point-at-a-time data line driver circuit and corresponding timing diagram.
Figure 3:
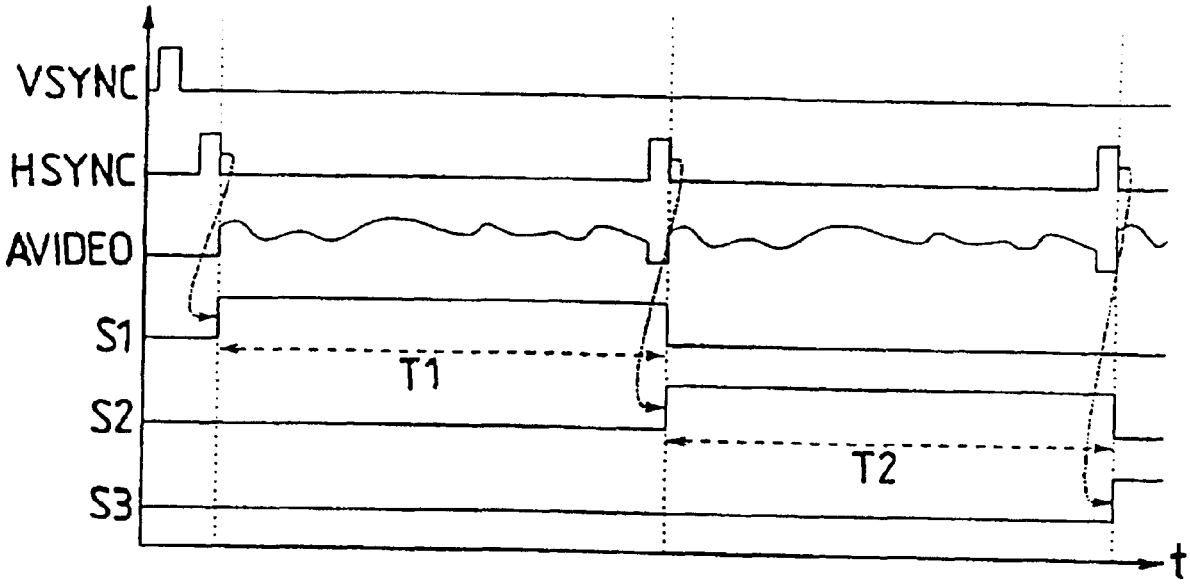
Figure 4A:
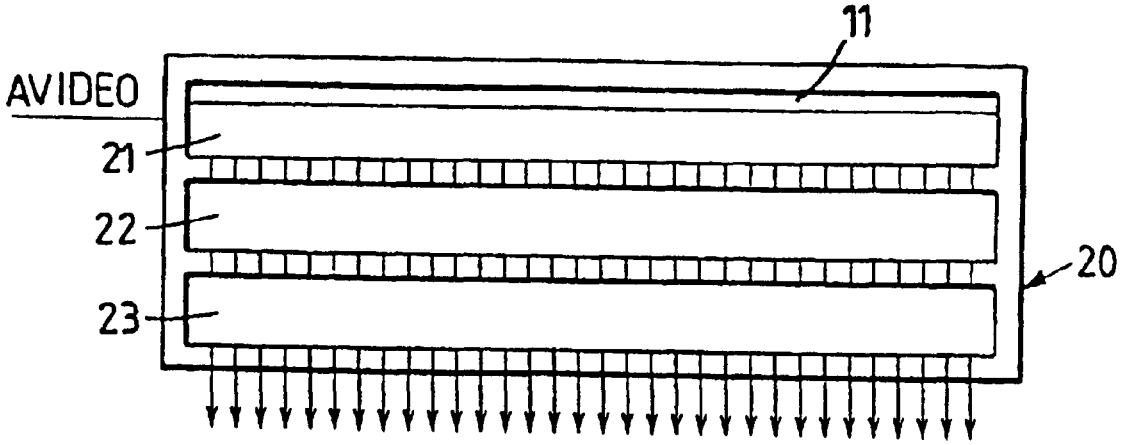
FIGS. 4*a*, 4*b*, 4*c*, and 5 show a prior art line-at-a-time data line driver circuit and corresponding timing diagram.
Figure 4B:
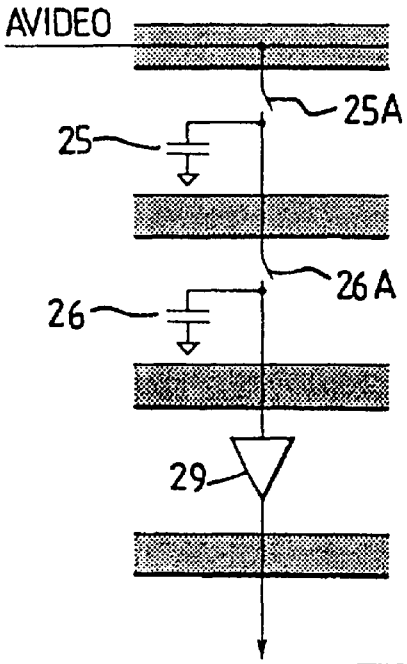
Figure 4C:
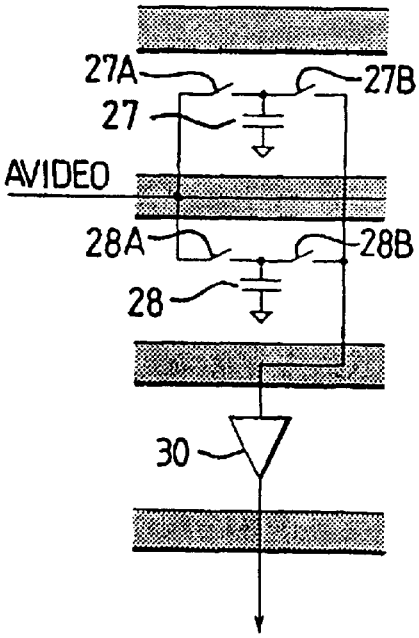
Figure 5:
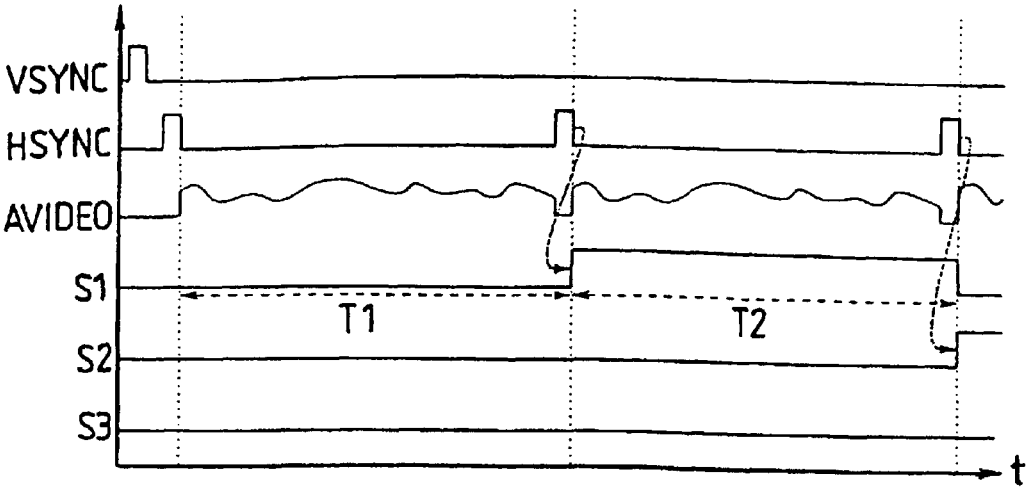
Figure 6:
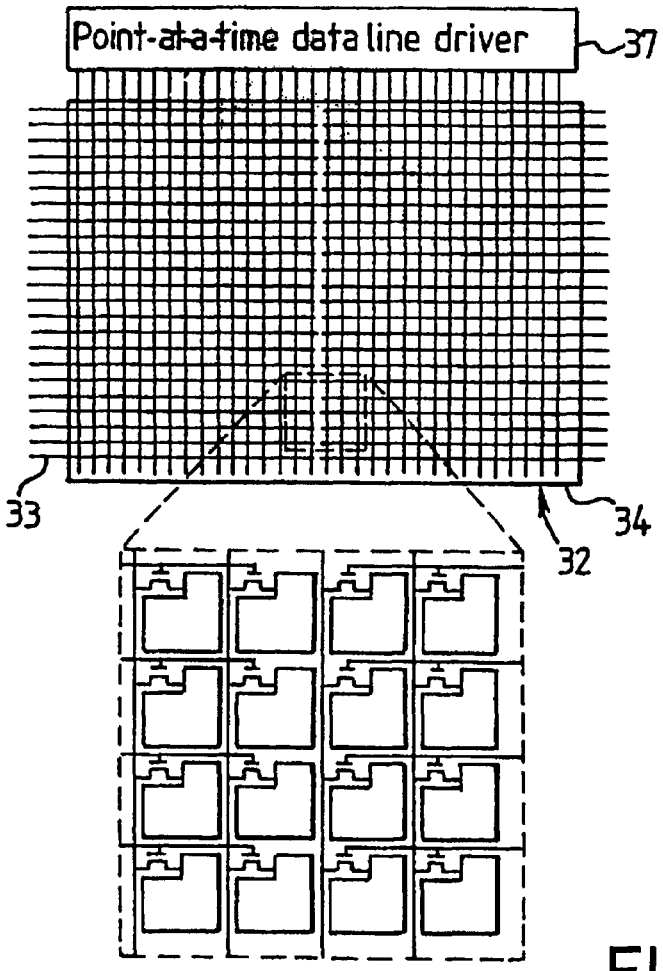
FIG. 6 diagrammatically shows a prior art AMLCD using a split scan line driving scheme.
Figure 11A:
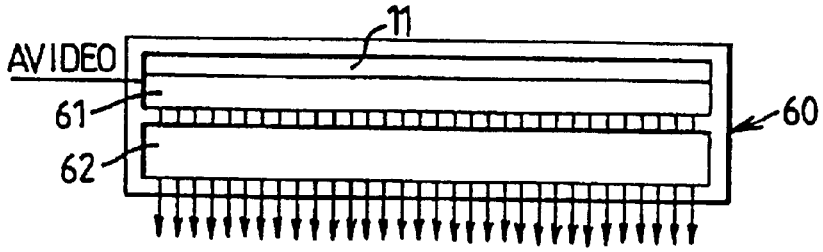
FIGS. 11*a* and 11*b* show a simplified analogue data line driver circuit for use with the invention.
Figure 11B:
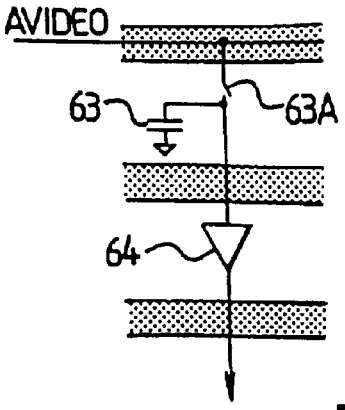

FIG. 11 shows an analogue data line driver circuit 60 which can be used in either of the above described embodiments and which incorporates a sampling shift register and a sampling circuit comprising capacitative memory elements 61 and line drivers 62 in the form of buffers for driving the data lines. FIG. 11 shows at (b) a circuit arrangement for such a data line driver circuit 60 in which the memory element for each data line comprises a single capacitor 63 and associated switch 63A and the line driver comprises a buffer 64. It will be appreciated that, as compared with the line-at-a-time data line driver circuit of FIG. 4, such a data line driver circuit 60 is considerably simplified since each memory element utilises at least one less capacitor and at least one less switch. Whilst such a reduction in component count provides only a relatively minor advantage for driver circuits integrated in silicon, it represents a much more significant advantage for monolithic driver circuits constructed with thin-film technology in view of the corresponding smaller implementation area and improved yield.

By comparison with the line-at-a-time driving scheme which provides a single-line pipeline delay, the pipeline delay which is normally available for charging the data lines in the half-line-at-a-time driving scheme described above is reduced to half a line period, and this means that the line drivers must charge the data lines more quickly. For an XGA (extended graphics array) display of 1024×768 pixels operating at 70 Hz, the half line period is equal to $1/(2\times70\times768)=9.3\ \mu s$. If the loading effect is modelled using single R and C elements, then the values of these components for a 12.1 inch diagonal XGA display will be of the order of 10KΩ and 100pF respectively. Buffers constructed from low-mobility polysilicon transistors have been shown to be capable of charging such loads to potentials of ±10 V well within 9.3 $\mu$s.

Figure 12:
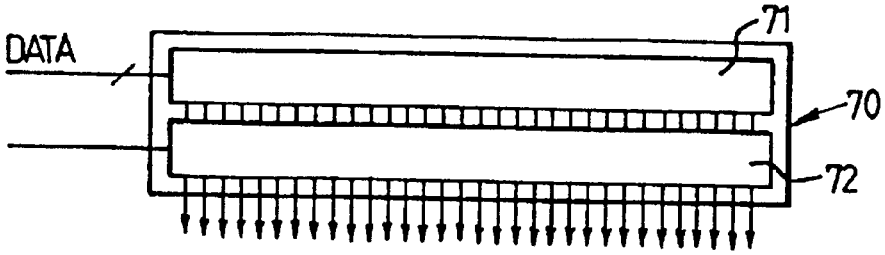
FIG. 12 shows a simplified digital data line driver circuit for use with the invention.

FIG. 12 shows a digital data line driver circuit 70 which can be used in either of the embodiments of the invention described above and which requires only a single storage register 71 in the form of digital latches, and line drivers 72 in the form of D/A converters and buffers connected to the outputs of the storage register 71 and supplied with reference voltages. Such a digital data line driver circuit 70 is described in more detail in British Patent Application No. (SLE 96055). It will be appreciated that such a data line driver circuit 70 requires less components than a conventional line-at-a-time data line driver circuit as described above since an additional input register is not required to store the RGB bits of input digital data. For an 8-bit colour XGA display, for example, adoption of such a driving scheme brings about a saving of 24×1024=24,576 one-bit latches. This is an important advantage since it improves both yield and power efficiency. The reduction in implementation area is even more important for monolithic drivers fabricated with low temperature polysilicon, for example, where the feature size of the transistors is quite large.

As already referred to above, it is necessary for the D/A conversion and data line driving to be completed within one half line period for such a driving scheme to operate successfully, and this is achievable with all of the major D/A conversion schemes as follows:

1. For parallel D/A conversion schemes based on charge sharing, the conversion time is approximately equal to the delay in charging the conversion capacitors plus the time it takes to share the accumulated charge with the data line capacitance (such a scheme is only suitable for small displays).
2. For parallel D/A conversion schemes based on summing amplifiers, the conversion time is approximately equal to the delay in charging of the conversion capacitors plus the time taken for the buffer amplifier to charge the line (that is the buffer amplifier current drive).
3. For algorithmic serial D/A conversion schemes, there is a fixed conversion delay per column driver which may be several microseconds which is still smaller than a typical half line period.
4. For ramp-based serial D/A conversion schemes where the conversion and data line charging occur simultaneously, the speed of the ramp dictates the conversion delay. The ramp must therefore traverse the range of pixel voltages in less than half a line period.

Figure 13A:
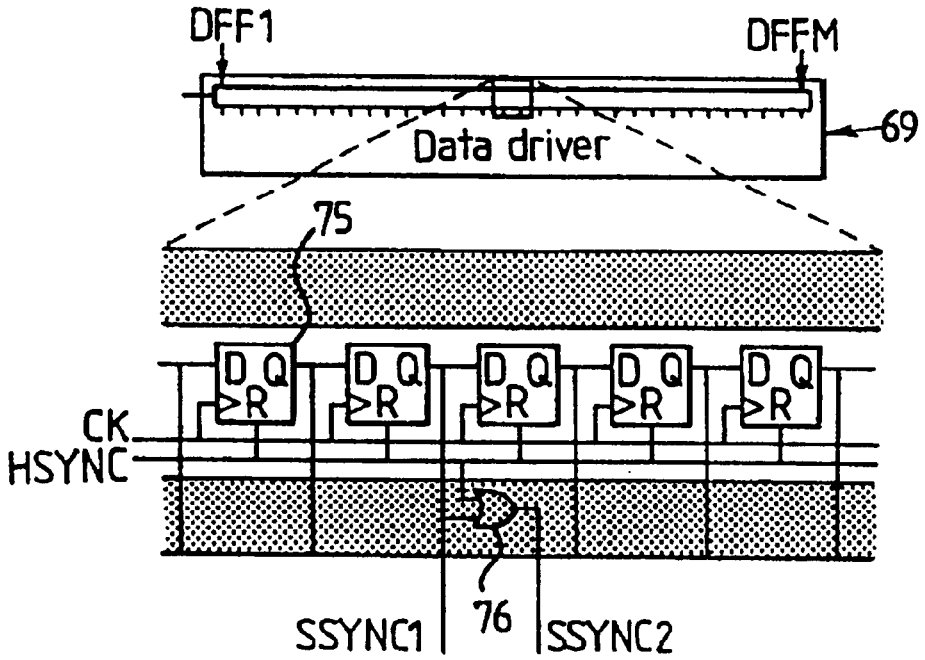
FIG. 13 shows a circuit arrangement for producing SSYNC signals and corresponding timing diagram.
Figure 13B:
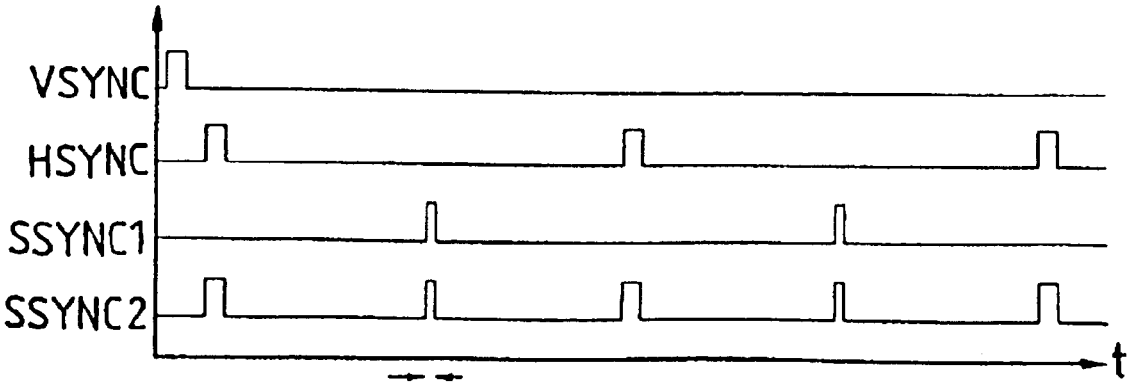
Figure 14:
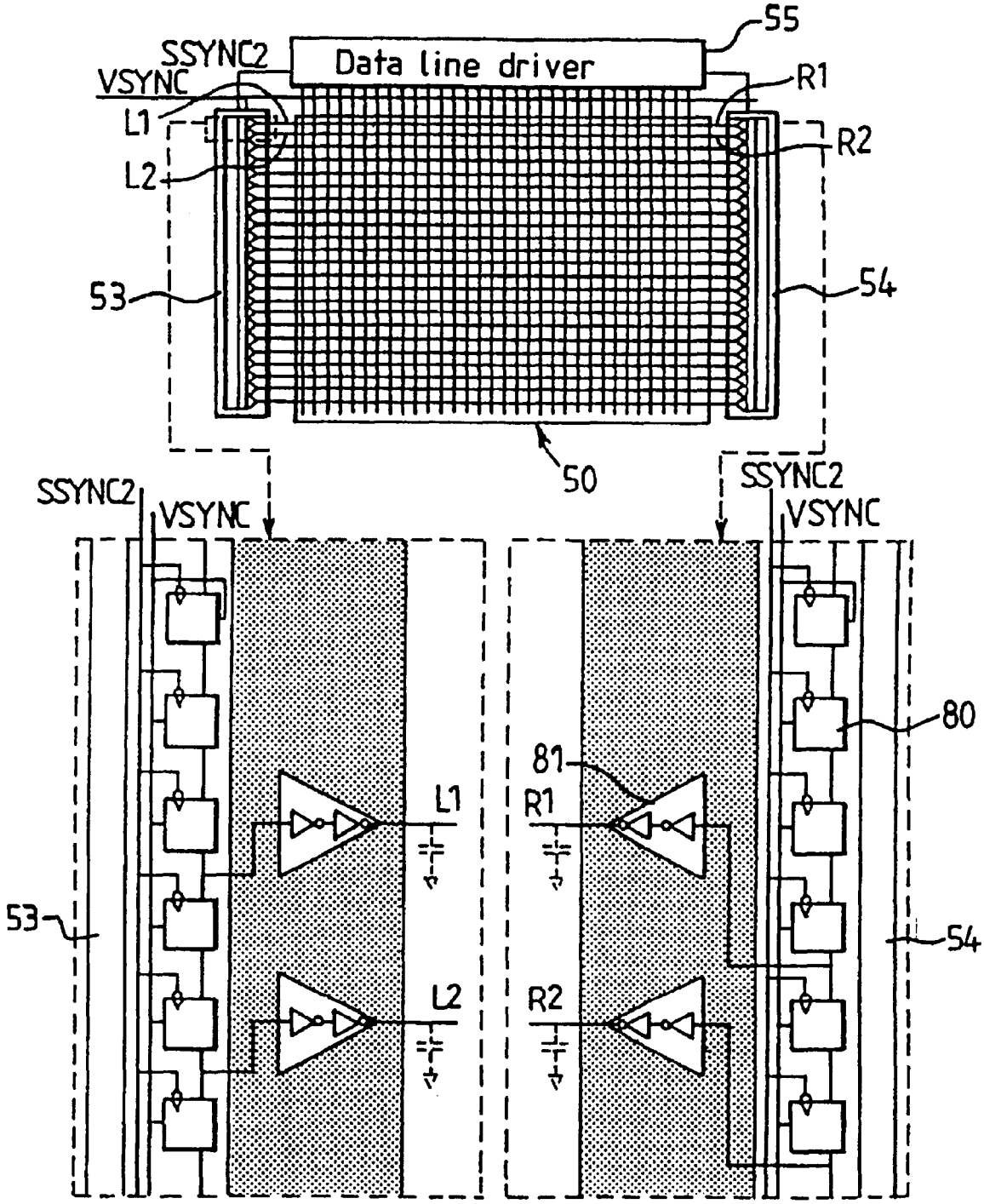
FIGS. 14, 15 and 16 diagrammatically show possible scan line driver circuits which can be used with the invention.
Figure 15:
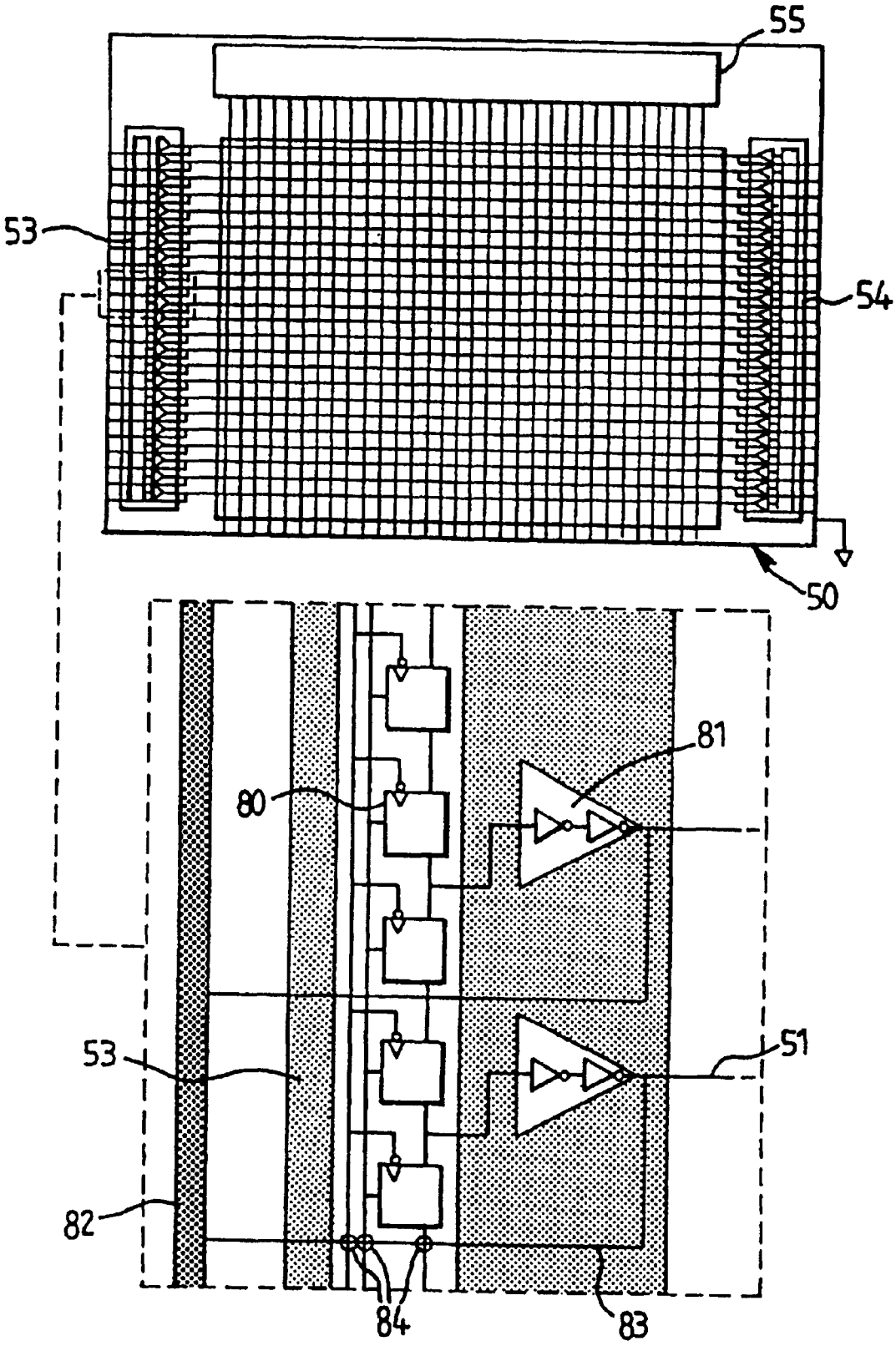

The scan line drivers for the above described embodiments must operate at different frequencies and/or must be phase shifted with respect to the line synchronisation pulse HSYNC. It is therefore necessary to generate SSYNC1 and SSYNC2 signals for both the switchable data line bank driving scheme of FIGS. 7 and 8 and the split scan line driving scheme of FIGS. 9 and 10, and a simple circuit arrangement for generating these signals will be described with reference to FIG. 13 which shows an enlarged centre portion of the sampling shift register 11 of a data line driver circuit 69 (which may correspond to the circuit 60 of FIG. 11, for example). The sampling shift register 11 is composed of a chain of D-type flip-flops 75, and the SSYNC1 signal is simply the output of the $(M/2-1)^{th}$ flip-flop since, when the circulating "1" reaches the centre of the shift register 74, a pulse having a falling edge coincident with the half line period is generated. Furthermore the line synchronisation pulse HSYNC is applied to one input of an OR gate 76 whilst the SSYNC1 signal is applied to the other input of the gate so as to generate the signal SSYNC2 at the output of the gate 76 which makes a rise and fall transition twice as frequently as the HSYNC pulse. In the switchable data line bank driving scheme of FIGS. 7 and 8, the signal SSYNC1 is supplied to the shift register of the scan line driver circuit, and the A and B switch signals can be generated from toggle flip-flops clocked with the signal SSYNC2. In the split scan line driving scheme of FIGS. 9 and 10, the signal SSYNC2 is supplied to the shift register or registers of the scan line driver circuit. Such a signalling technique is more practical for monolithic data and scan line driver circuits where it is relatively straightforward for signals to be transferred between the two types of driver circuit. The timing diagram at (b) in FIG. 13 shows the relative timing of the signals VSYNC, HSYNC, SSYNC1 and SSYNC2.

The scan line driver circuit for the switchable data line bank driving scheme is of generally standard construction except that a phase shift relative to the line synchronisation must be effected by use of the SSYNC1 signal. For the split scan line driving scheme, two options exist for the scan line driver circuit as will be described below. In a first option shown in FIG. 14, each of the left and right hand scan line driver circuits 53 and 54 comprises a shift register composed of a chain of D-type flip-flops 80 (although an alternative structure comprising latches and combinational logic may also be used) controlled by the frame synchronisation pulse VSYNC and the SSYNC2 signal which has two triggering pulses per line period. The output of every other flip-flop 80 in the shift register is connected to a scan line buffer 81 which can be formed from two appropriately scaled inverters, for example. Considering the left hand scan line driver circuit 53 first, it is initialised by the VSYNC pulse such that the contents of the shift register become "10000000 . . . " (reading the states of the flip-flops 80 from the top downwards). After two falling edges of the SSYNC2 signal (see FIG. 10), the contents of the shift register change to "00100000 . . . " and the scan voltage L1 goes high and remains high for one half of the line period. The scan voltage L2 does not go high until a full line period later when the contents of the shift register are changed to "00001000 . . . ". The right hand scan line driver circuit 54 operates in similar manner. However, for a given row of pixels, the right hand scan line buffer is connected to a flip-flop 80 one stage further down the shift register than the equivalent left hand scan line buffer. This ensures that the scan pulses are half a line period out of phase.

If the split scan line driving scheme is applied to displays which have separate LSI driver chips bonded onto the display panel, the connection of the scan lines to a ground potential to protect the TFT's during liquid crystal surface preparation (rubbing) does not present a problem. However, for monolithic driver circuits integrated on the same substrate as the display TFT's, care must be taken to ensure that the scan lines 51 can be accessed from the edge of the substrate so that they can be grounded by connection to a guard ring. As shown diagrammatically in FIG. 15, the connection of the scan lines 51 to the guard ring 82 can be effected by lines 83 which overlap the shift register connecting lines at points 84 in which case two conducting layers are required in the structure.

Figure 16:
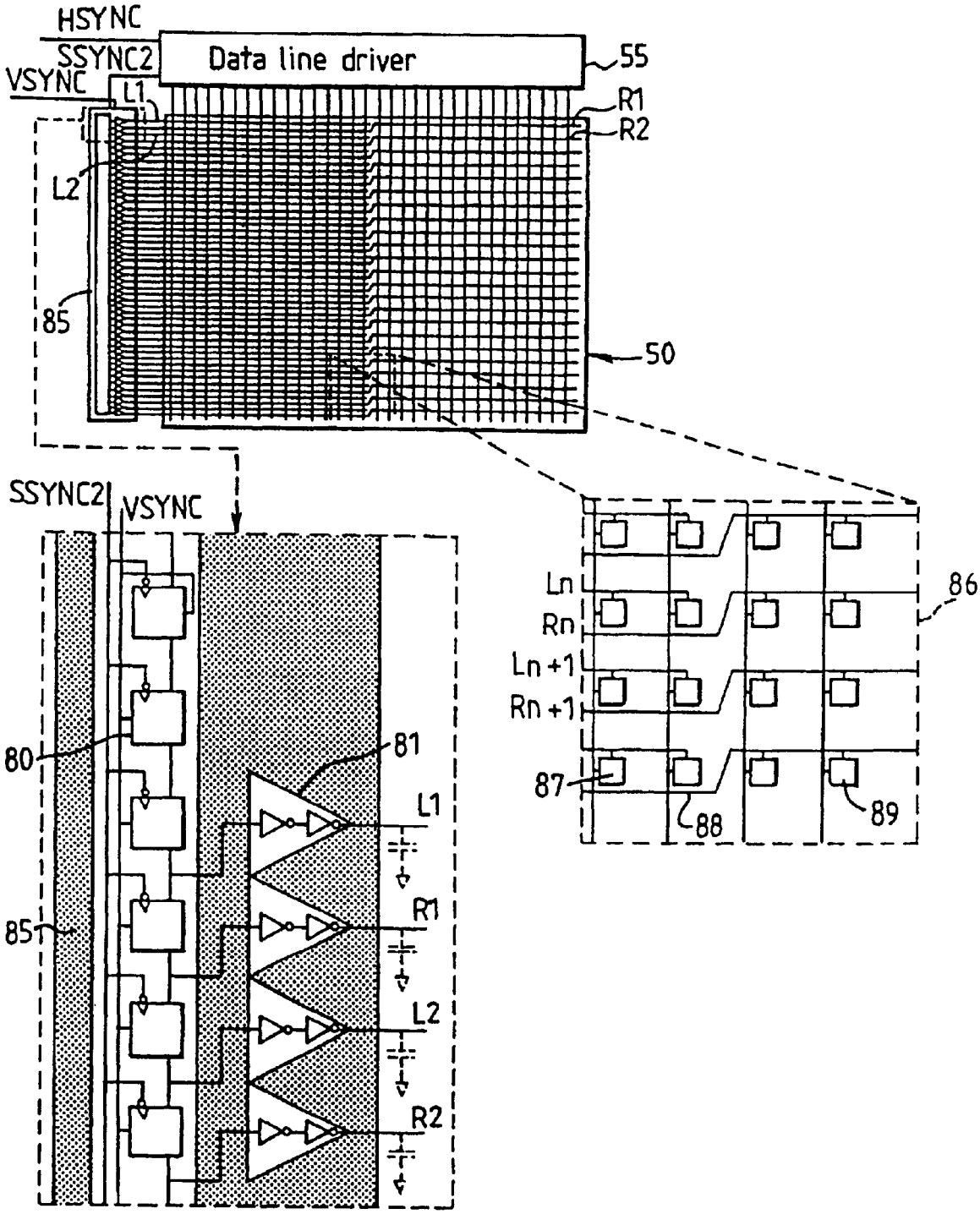
Figure 17:
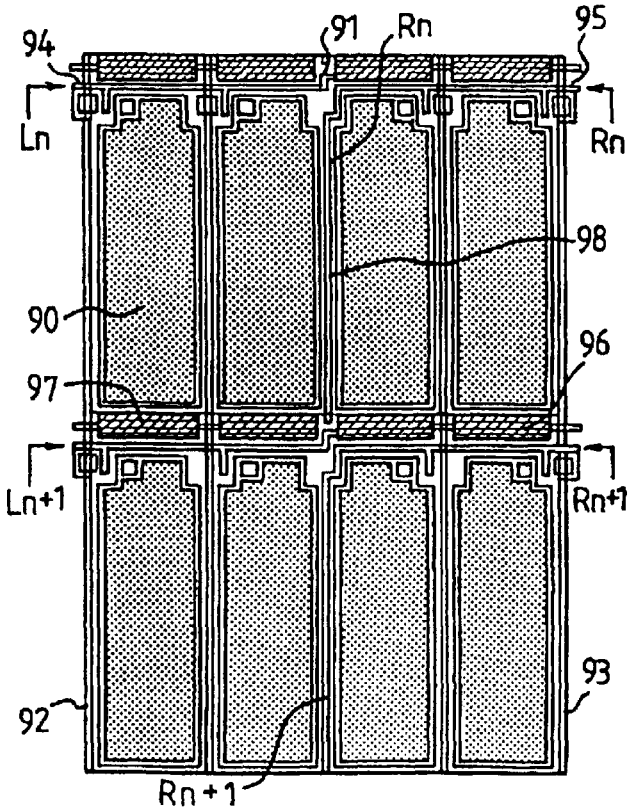
FIG. 17 shows a pixel layout which can be used with the invention.

The main disadvantage of the above described scan line driver circuits is that they contain redundant flip-flops in both shift registers which are used to control the wait state when the other scan line driver circuit is scanning half of the display. However, for emissive or reflective displays integrated on active substrates, the circuit arrangement can be simplified by using a scan line driver circuit 85 comprising a single shift register to generate both the left and right hand scan voltages, as shown in FIG. 16. As best seen in the enlarged detail 86 of this figure, the left hand group of pixels 87 also contains the scan line 88 to the corresponding right hand group of pixels 89, although this does not affect the pixel aperture ratio. This arrangement can also be used for transmissive displays, although the aperture ratio of the left hand group of pixels will suffer if they contain two lines routed on the same layer. A first solution to this problem is to route the right hand scan line on top of the left hand scan line in a different layer, although this will have the disadvantageous effect of introducing an overlap capacitance between the scan lines requiring higher drive buffers. A second solution is to maximise the use of the other scan line by using it to form the bottom plate of the pixel storage capacitance so that this scan line replaces the extra pixel capacitance line that is normally present in a row of pixels. FIG. 17 shows a detail of such a display arrangement consisting of eight pixels 90 grouped about the centre 91 of the display and incorporating left hand data lines 92 and right hand data lines 93, as well as left hand scan lines 94 and right hand scan lines 95. As may be seen in the figure, each of the left hand scan lines 94 forms a capacitance plate 96 for each of the right hand pixels of the corresponding row, whereas each of the right hand scan lines 95 forms a capacitance plate 97 for each of the left hand pixels of the following row (due to the step 98 in the right hand scan line 95).

Figure 18:
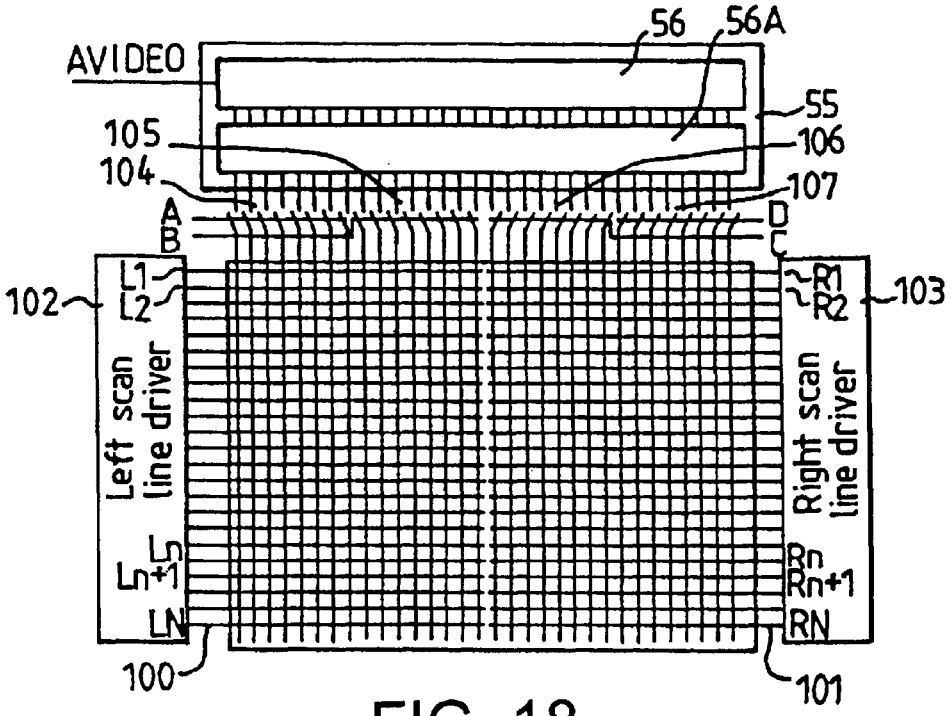
FIGS. 18 and 19 show an AMLCD according to a third embodiment of the invention and corresponding timing diagram.
Figure 19:
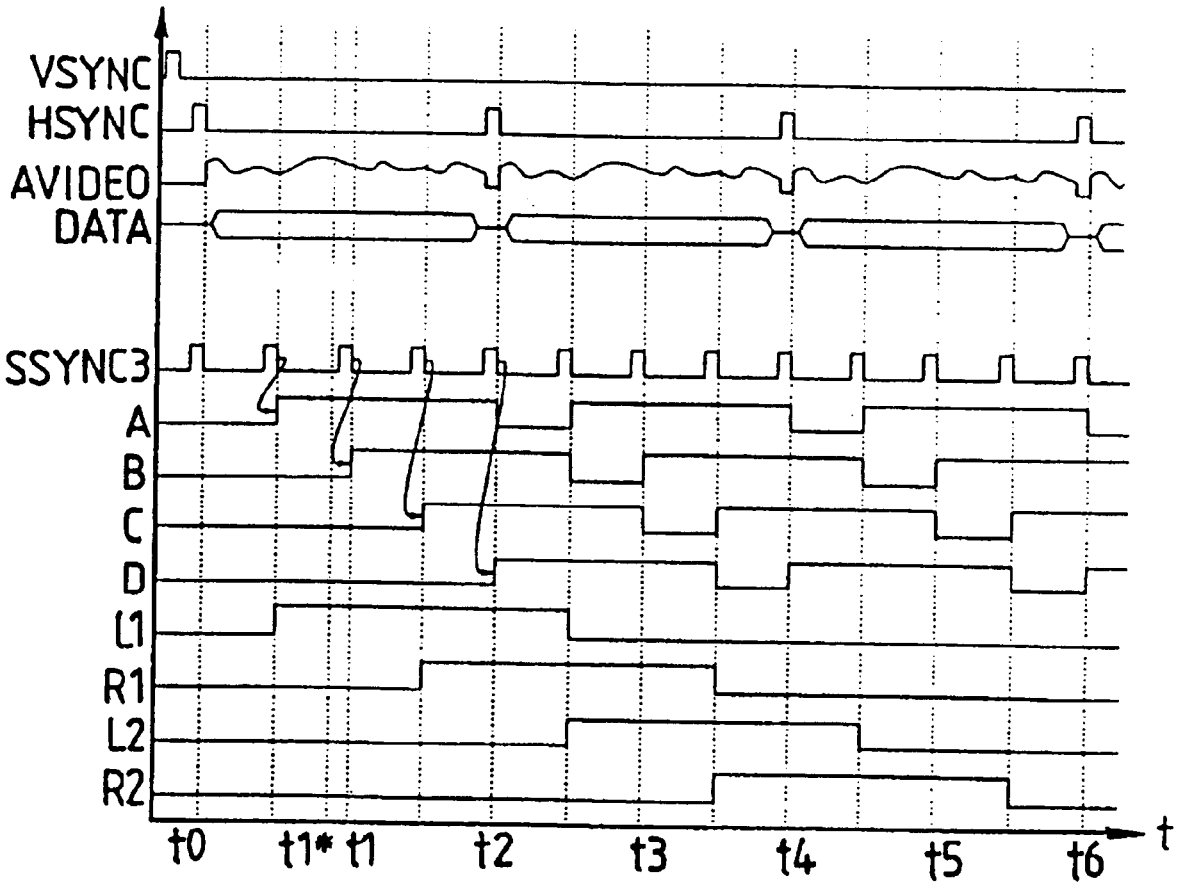

Although each of the above described embodiments utilises a half-line-at-a-time driving scheme, other driving schemes are also contemplated within the scope of the invention as already discussed, and a three-quarter-line-at-a-time driving scheme will now be described with reference to FIGS. 18 and 19 as an example of a possible alternative driving scheme. Since the data line driver circuit 55 of such a driving scheme uses a single line memory 56 and is generally similar to the data line driver circuit of FIG. 9, the same reference numerals are used for these parts in FIG. 18 as in FIG. 9. As in the embodiment of FIG. 9, the left hand scan lines 100 are connected to a left hand scan line driver circuit 102 and the right hand scan lines 101 are connected to a right hand scan line driver circuit 103. However the outputs of the data line driver circuit 55 are divided into four banks 104, 105, 106 and 107 connected to the data lines by switches controlled by switch signals A, B, C and D respectively. The frequency and timing of the switch signals A, B, C and D is shown in the timing diagram of FIG. 19, together with the other signals previously discussed with reference to FIG. 10 and a further scan synchronisation signal SSYNC3. The SSYNC3 signal can be generated by an arrangement similar to that described above with reference to FIG. 13 but with the provision of tap points a quarter and three quarters of the way along the sampling shift register.

Such a driving scheme has the advantage that the display is driven three quarters of a line at a time so that, at any instant, three quarters of a row of pixels is being scanned. This means that three quarters of a line period is available for the data line driver circuit 55 to perform D/A conversion (if the data line driver circuit is digital) and to charge the data lines. An alternative three-quarter-line-at-a-time driving scheme utilises multiple independently controlled scan lines per row, although this requires more scan line driver circuits and more scan lines routed through the pixels. The constraints imposed by pixel aperture ratio limit this technique to reflective and emissive types of display. However, by using four carefully controlled scan lines per row, each of which is active for three quarters of a line period, the conversion and data line charging time can be increased by 50% with respect to the split scan line driving scheme described with reference to FIGS. 9 and 10.

What is claimed is:

1. An active matrix device comprising:

a plurality of data lines;

a plurality of scan lines;

an active matrix of control elements arranged in rows and disposed at intersections of the data lines and scan lines, the control elements having data inputs connected to the data lines and scan inputs connected to the scan lines such that each control element is addressable by a combination of data signals and a scan signal applied to a corresponding one of the data lines and a corresponding one of the scan lines; and an addressing element arranged so as to address the rows of control elements in successive line periods in response to an input signal, the addressing element including:

a data line driver circuit arranged so as to sample the input signal to produce the data signals for each of the rows of control elements in a corresponding line period, the data line driver circuit being further arranged so as to apply said data signals to the data lines; and a scan line driver circuit arranged so as to address the scan lines sequentially by applying the scan signal to the scan inputs of the control elements along each of the rows so as to supply said data signals applied to the data lines to the control elements along said row on receipt of said scan signal by the control elements, wherein the data line driver circuit further includes:

a first actuator arranged so as to sample and store the input signal to produce the data signals for a first group of the control elements along said row in a first subperiod of said one line period, the first actuator being further arranged so as to supply said data signals to the first group of control elements in a second subperiod of said one line period; and a second actuator arranged so as to sample and store the input signal to produce the data signals for a second group of control elements along said row in a subperiod which is at least partly coextensive with the second subperiod, the second actuator being further arranged so as to supply said data signals to the second group of control elements in a subsequent subperiod, and the data line driver circuit contains the same number of elements for sampling and storing the input signal in the data line driver circuit as there are control elements in a single row of the active matrix.

2. An active matrix device according to claim 1, wherein the second actuator is adapted to supply said data signals to the second group of control elements in a first subperiod of a further one of the line periods following said one line period.

3. An active matrix device according to claim 1, wherein the data line driver circuit includes first and second driving elements, the first actuator includes a first switching element arranged so as to isolate the first driving element from the first group of control elements in the first subperiod, the first switching element being further arranged so as to couple the first driving element to the first group of control elements in the second subperiod, and the second actuator includes a second switching element arranged so as to isolate the second driving element from the second group of control elements in the second subperiod, the second switching element being further arranged so as to couple the second driving element to the second group of control elements in said subsequent subperiod.

4. An active matrix device according to claim 3, wherein the data line driver circuit includes a data shift register having a plurality of stages corresponding to the number of data lines, and the first and second driving elements each includes a proportion of said stages and associated line drivers.

5. An active matrix device according to claim 4, wherein the first and second driving elements each include half of said stages of the data shift register and associated line drivers.

6. An active matrix device according to claim 3, wherein the first and second switching elements each include a series of switching elements, each of the series of switching elements being connected to a respective one of the data lines.

7. An active matrix device according to claim 1, wherein each row is addressable by first and second separately addressable scan lines, the first actuator includes a first scanning element of the scan line driver circuit arranged so as to apply a first scan signal to said first scan line to supply said data signals to the first group of control elements in the second subperiod, and the second actuator includes a second scanning element of the scan line driver circuit arranged so as to apply a second scan signal to said second scan line to apply said data signals to the second group of control elements in said subsequent subperiod.

8. An active matrix device according to claim 7, wherein the plurality of the data lines include first data lines corresponding to said first scan line and second data lines corresponding to said second scan line, the first data lines are permanently connected to first line drivers of the data line driver circuit, and the second data lines are permanently connected to second line drivers of the data line driver circuit.

9. An active matrix device according to claim 7, wherein the plurality of the data lines include first data lines corresponding to said first scan line and second data lines corresponding to said second scan line, the first data lines are connected to first and second line drivers of the data line driver circuit by first and second switching elements, the second data lines are connected to third and fourth line drivers of the data line driver circuit by third and fourth switching elements, and the data line driver circuit is adapted to apply data signals to data lines of subgroups of the first and second groups of control elements while the input signal is being sampled for other subgroups of the first and second groups of control elements during each subperiod.

10. An active matrix device according to claim 7, wherein the first and second scanning elements include respective scanning shift register each of which has a plurality of stages and to each of which a frame synchronisation signal is applied, said first scan lines being connected to alternate stages of the first scanning element, and said second scan lines being connected to alternate stages of the second scanning element which are one stage out of phase with the stages of the first scanning element to which the first scan lines are connected.

11. An active matrix device according to claim 7, wherein the first and second scanning elements include different stages of common scanning shift register in which the stages of the first scanning element alternate with the stages of the second scanning element, and said second scan lines are connected to the second scanning element by connecting portions which run along side said first scan lines.

12. An active matrix device according to claim 11, wherein the connecting portions of the second scan lines form plates of first storage capacitor associated with the first group of control elements, and also connecting portions of the first scan lines form plates of second storage capacitor associated with the second group of control elements.

13. An active matrix device according to claim 1, wherein the addressing element is adapted to sample an analogue input signal and store the data signals for a corresponding group of control elements in each line subperiod, and to supply the data signals to said group of control elements in at least one subsequent line subperiod at the same time as the analogue input signal is sampled to produce the data signals for the next group of control elements.

14. An active matrix device according to claim 1, wherein the addressing element is adapted to sample a digital input signal in each line subperiod to produce digital signals which are subsequently converted to the data signals for a corresponding group of control elements and to complete conversion of the digital signals and to supply the data signals to said group of control elements in at least one subsequent line subperiod at the same time as the digital input signal is sampled to produce the data signals for the next group of control elements.

15. An active matrix device according to claim 1, wherein the data line driver circuit includes scan synchronisation element arranged so as to generate a scan synchronisation signal which is out of phase with respect to a line synchronisation signal for timing the line periods, the scan synchronisation signal serving to time at least one transition between successive subperiods within the same line period.

16. An active matrix device according to claim 15, wherein the data line driver circuit includes data shift register which has a plurality of stages corresponding to the number of data lines and to which the line synchronisation signal is applied, and the scan synchronisation element is connected to an output of an intermediate one of said stages to provide said scan synchronisation signal which is out of phase with respect to the line synchronisation signal.

17. An active matrix device according to claim 1, wherein the data line driver circuit includes only a single data memory for each data line.

18. An active matrix device according to claim 1, wherein the second group of control elements are in the same row as the first group of control elements.

* * * * *